United States Patent [19]

Hrescak

[11] 4,227,680

[45] Oct. 14, 1980

[54] HYDRAULIC WINCH

[75] Inventor: Stan Hrescak, Burnaby, Canada

[73] Assignee: B. C. Gearworks Ltd., Delta, Canada

[21] Appl. No.: 16,197

[22] Filed: Feb. 28, 1979

[51] Int. Cl.[3] ..... B66D 1/22; B66D 1/24

[52] U.S. Cl. ..... 254/344; 74/785; 74/810; 254/356; 254/361

[58] Field of Search ..... 254/187.4, 187.5, 187.6, 254/187.7, 187.8, 187.1, 187.2, 187.3, 186 R, 186 HC, 185 A, 173 A, 150 R, 150 FH, 149; 74/785, 810

[56] References Cited

U.S. PATENT DOCUMENTS

| | | | |
|---|---|---|---|
| 2,749,772 | 6/1956 | O'Malley | 74/785 X |
| 2,959,396 | 11/1960 | Lawrence | 254/187.1 X |
| 3,069,929 | 12/1962 | Hansen | 74/785 |
| 3,319,492 | 5/1967 | Magnuson | 254/150 R X |
| 3,519,247 | 7/1970 | Christison | 254/186 X |
| 3,901,478 | 8/1975 | Peterson | 254/187.1 |
| 4,118,013 | 10/1978 | Christison et al. | 254/187.5 |

*Primary Examiner*—John M. Jillions

*Attorney, Agent, or Firm*—Townsend and Townsend

[57] ABSTRACT

A rapid reverse winch has a hollow winding drum and a hydraulic motor to a first side of the drum. A drive shaft extends inwardly from the motor and is connected to a primary sun gear near the center of the drum. A primary internal gear extends about the primary sun gear. There is a primary planet hub between the primary sun gear and the primary internal gear and a plurality of planet gears rotatably mounted on the primary planet hub are in mesh with the primary sun gear and the primary internal gear. A final drive sun gear to a second side of the drum is connected to the primary planet housing. A non-rotatable final drive housing extends about the final sun gear. There is a final drive planet hub between the final drive sun gear and the final drive housing with a plurality of planet gears in mesh with the final drive internal gear and the final drive sun gear. A sprag clutch between the drive shaft and the primary internal gear permits rotation between the drive shaft and the primary internal gear when the motor rotates the drum in a winding-in direction. The clutch non-rotatably interconnects the primary internal gear and the drive shaft when the drum is rotated in a reeling-out direction opposite to the winding-in direction.

11 Claims, 2 Drawing Figures

HYDRAULIC WINCH

BACKGROUND OF THE INVENTION

This invention relates to a hydraulic winch with a rapid reverse feature.

In the prior art, U.S. Pat. No. 2,959,396 to Lawrence discloses a hydraulic winch with a rapid reverse feature. The increased reeling-out speed is accomplished through the use of cam clutches between the planet gears and their spindles. The widespread acceptance of this winch has been restricted due to the fact that the planet gear spindle shear pins tend to shear under shock loading. This creates a very dangerous condition.

U.S. Pat. No. 3,066,917 to Tuplin relates to portable winches adapted to be mounted on vehicles. The winch has a provision for changing the gear ratio depending upon whether the winch is reeling out or reeling in. When winching in, planetary gears are rendered inoperative by free-wheels.

U.S. Pat. No. 3,572,599 to Hilmer discloses a speed reducer in combination with a winch spool.

U.S. Pat. No. 3,711,065, also to Lawrence, discloses a marine winch including unidirectional clutch means mounted between the exterior of the turret and the interior of the drum sleeve and clutch.

U.S. Pat. No. 2,014,683 to Hubert deals with a cathead control mechanism.

SUMMARY OF THE INVENTION

According to the invention, a rapid reverse hydraulic winch comprises a hollow winding drum rotatable about a longitudinal central axis and a motor to a first side of the drum with a drive shaft extending towards a second side of the drum. There is a primary sun gear connected to an inside end of the drive shaft, a primary internal gear extending about the primary sun gear, a primary plant hub between the primary sun gear and the primary internal gear and a plurality of planet gears rotatably mounted on the primary planet hub in mesh with the primary sun gear and the primary internal gear. There is a final sun gear to the second side of the drum and connected to the primary planet hub, a non-rotatable final drive housing with a final internal gear extending about the final sun gear, a final drive planet hub between the final drive sun gear and the final drive housing and connected to the drum and a plurality of planet gears rotatably mounted on the final drive planet hub in mesh with the final internal gear and the final sun gear. There is free-wheel means between the drive shaft and the primary internal gear permitting rotation between the drive shaft and the primary internal gear when the motor rotates the drum in a winding-in direction and non-rotatably interconnecting the primary internal gear and the drive shaft when the drum is rotated in a reeling-out direction opposite to the winding-in direction.

When compared with the prior art, a rapid reverse hydraulic winch according to an embodiment of the invention offers distinct advantages. For example, locating the free-wheel means between the drive shaft and the primary internal gear not only simplifies the construction of the winch, but is considerably more rugged than winches where the free-wheel means is between the primary planet gears and their spindles. In particular, there is no longer a tendency for the shear pins in the primary planet gear spindles to shear under shock loading. The reliability and acceptance of such winches are thereby considerably enhanced. Since the shear pins in the primary planet gear spindles don't shear, this winch will take a maximum load at maximum speed unlike prior art winches.

The location of the primary sun gear and primary planet gears within the hollow drum allows additional room in the end housing for a multi-disc brake. This provides smoother operation and eliminates the chatter encountered with single disc brakes used with some prior art winches.

The particular configuration of bearings employed with a hydraulic winch according to the invention is particularly rugged and improves the smooth operation of the winch.

In the drawings:

FIG. 1 is an isometric view of a hydraulic winch according to an embodiment of the invention; and FIG. 2 is an elevational view, partly in section, of a winch according to an embodiment of the invention.

DESCRIPTION OF THE PREFERRED EMBODIMENTS

Figure 1:
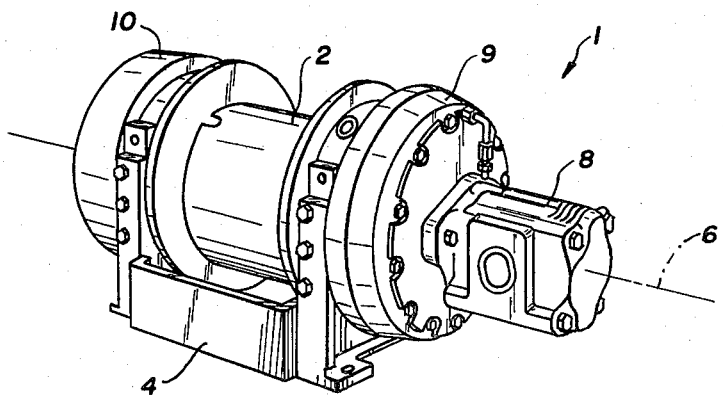
Figure 2:
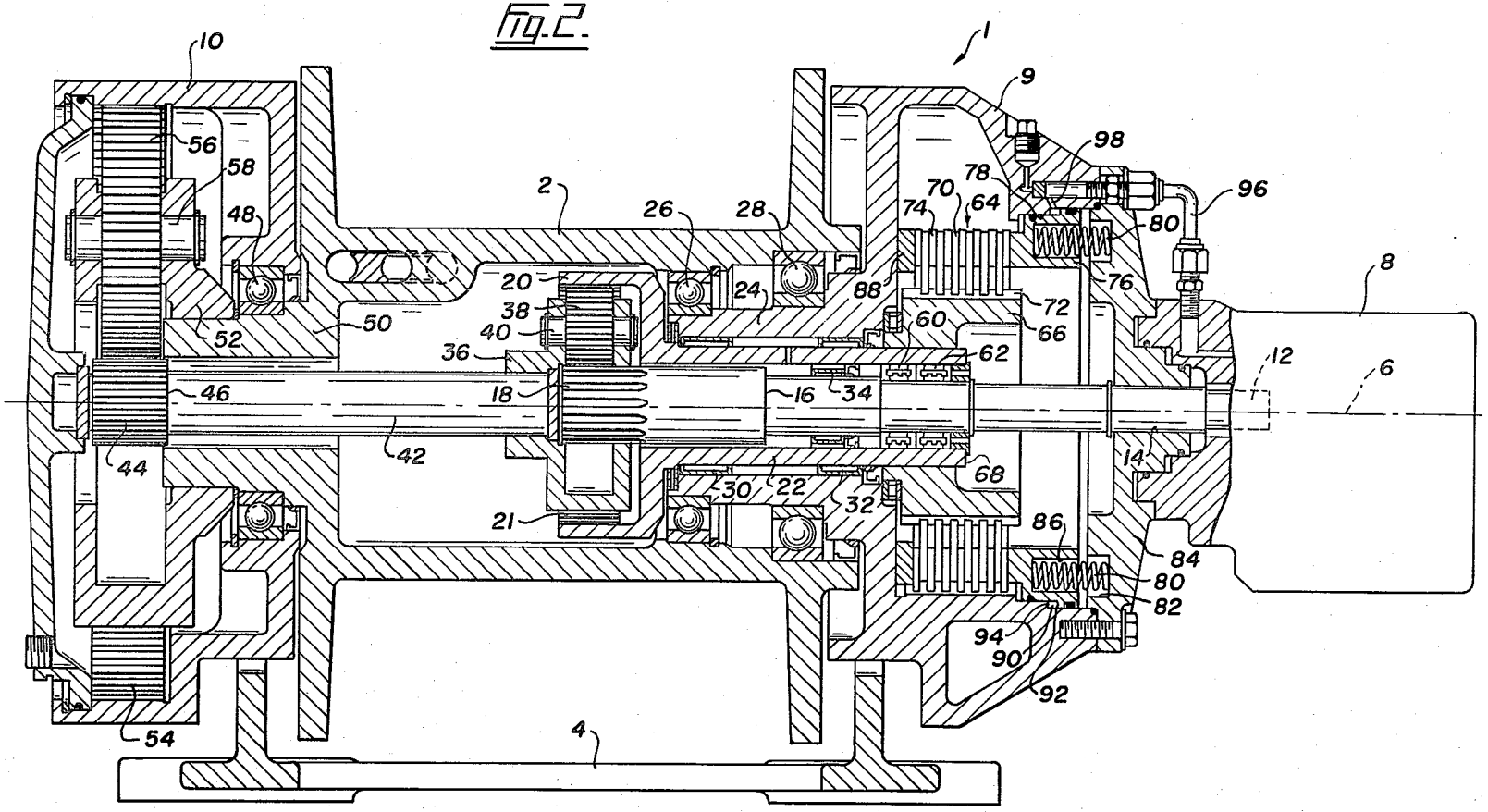

Both FIGS. 1 and 2 show hydraulic winches 1 according to embodiments of the invention including a hollow winding drum 2 mounted on a winch base 4 for rotation about a longitudinal central axis 6. There is a reversible hydraulic motor 8 mounted on an end housing 9 to the right or first side of the drum 2 from the point of view of the drawings. Also from the point of view of FIGS. 1 and 2, there is non-rotatable final drive housing 10 to the left or second side of the drum 2. Both housings 9 and 10 are connected to the winch base 4.

Referring specifically to FIG. 2, the winch 1 includes a drive shaft 12 which is coaxial with axis 6 and is operatively connected to the motor 8. Drive shaft 12 extends inwardly towards the left side of the drum 2 through aperture 14 in the cap 84 of end housing 9. The inner end 16 of the drive shaft 12 is connected to a primary sun gear 18 by suitable non-rotatable means such as splines. The primary sun gear 18 is located within the hollow drum 2 generally near the centre thereof. A primary internal gear 20, with internal gear teeth 21, extends about the sun gear 18 concentrically therewith. Internal gear 20 has an integral sleeve 22 extending towards the right side of the drum about the drive shaft 12 and concentrically therewith.

The end housing 9 has an inner tubular projection 24 extending within the right side of the drum. An inner ball race 26 and an outer ball race 28 between the projection 24 and the drum 2 rotatably support the drum. An inner needle bearing race 30 and an outer needle bearing race 32 between the sleeve 22 and the projection 24 rotatably support the primary internal gear. Needle bearing 34 between the sleeve 22 and drive shaft 12 rotatably supports the drive shaft.

A primary planet hub 36 is located between sun gear 18 and internal gear 20. Three planet gears 38 are rotatably mounted 120° apart about planet hub 36 by means of pins or spindles 40. Although there are three indentical sets of planet gears 38 and spindles 40, only one set is shown in FIG. 2. Planet gears 38 are in mesh with both sun gear 18 and gear teeth 21 of internal gear 20.

Planet hub 36 is connected to a shaft 42 which extends beyond the left side of the drum 2. A final drive sun gear 44 is located to the left or second side of drum 2 at the outside end 46 of the shaft 44. Sun gear 44 is connected to hub 36 by shaft 42. The final drive housing 10, already mentioned, surrounds sun gear 44. A ball race 48 between the housing 10 and the outside projection 50 of the drum 2 rotatably supports the left side of the drum 2.

A final drive planet hub 52 is connected to the projection 50 of drum 2 between the internal gear teeth 54 of drive housing 10 and the sun gear 44. Three planet gears 56, spaced 120° apart, are rotatably mounted on planet hub 52 by means of pins or spindles 58. Again, only one of the planet gears 56 is shown and the rest are identical. Planet gears 56 mesh with both the sun gear 44 and the internal gear teeth 54 of final drive housing 10.

The winch 1 includes free-wheel means or sprag clutches 60 and 62, also referred to as cam locks. The sprag clutches extend about drive shaft 12 between the drive shaft and sleeve 22 of primary internal gear 20. Sprag clutches are well known and permit relative rotation between sleeve 22 and shaft 12 in one direction of rotation while interconnecting the drive shaft and the sleeve in the opposite direction of rotation.

The winch 2 has a brake 64 for resisting rotation between sleeve 22 and end housing 9. Brake 64 consists of a brake hub 66 connected to the right end 68 of sleeve 22. A plurality of spaced-apart annular brake discs 70 are connected to hub 66 by means of splines 72. A plurality of spacer discs 74 are interposed therebetween. For illustrative purposes, FIG. 2 shows six brake discs 70 and seven spacer discs 74. Twelve brake discs and thirteen spacer discs are used on certain models of the winch.

The brake 64 also consists of an annular piston member 76. The piston member 76 is slidably received within the cylindrical recess 78 of end housing 9. A plurality of coil springs 80 are compressed between cylindrical recesses 82 of cap 84 on housing 9 and cylindrical recesses 86 of piston member 76. Springs 80 normally force brake discs 70 and spacer discs 72 together and against annular spacer 88.

The winch 1 has means for releasing the brake 64. The means for releasing comprises an annular space 90 between housing 9 and piston member 76 which includes an outer wall 92 on the piston member and an inner wall 94 on the housing. A conduit 96 for hydraulic fluid, including a passage 98 communicating with annular space 90, connects the space 90 to the hydraulic motor 8. Pressurized hydraulic fluid is only supplied to conduit 96 during the reverse operation of motor 8 for reeling-out of drum 2.

In operation, hydraulic motor 8 is operated in a forward direction, for example clockwise from the point of view of FIG. 1 for the reeling-in of drum 2. Sprag clutches 60 and 62 permit rotation of drive shaft 12 relative to sleeve 22 of primary internal gear 20 in the clockwise direction. Brake 64 is engaged by springs 80 during this forward operation of motor 8 since pressurized hydraulic fluid is not supplied to space 90 through conduit 96 to move piston member 76 away from the brake discs.

As primary sun gear 18 is rotated by drive shaft 12, planet gears 38 are rotated about sun gear 18 rotating primary planet hub 36 and shaft 42 at a reduced rotational speed. Shaft 42 rotates final drive sun gear 44 which rotates planet gears 56 both about the pins 58 and the sun gear 44, rotating final drive planet hub 52 about sun gear 44 at a further reduced speed. Since final drive planet hub 52 is connected to extension 50 of drum 2, the motor 8 thus rotates the drum 2 at a considerably reduced speed. In one particular model of the winch, a total reduction ratio of 41:1 is achieved.

Once the winding-in is completed, motor 8 stops and, since pressurized hydraulic fluid is not supplied through conduit 96 to urge piston member 76 away from brake discs 70, the coil springs 80 act to apply brake 64 and stop drum 2. When the cable wound on drum 2 is tensioned by a load, it tends to reel-out the cable from drum 2 and rotate the drum in the opposite direction from the winding-in direction, for example counterclockwise from the point of view of FIG. 1. The drum 2 tends to rotate final drive planet hub 52 and thereby sun gear 44 and shaft 42. Shaft 42 is connected to primary planetary hub 36 and tends to rotate it and the planet gears 38 about sun gear 18. However, rotation of sun gear 18 relative to primary internal gear 20 is prevented by the sprag clutches 60 and 62 between sleeve 22 of primary internal gear 20 and the drive shaft 12. Brake 64 prevents rotation of sleeve 22.

For the unwinding of cable from drum 2, hydraulic fluid must be applied to motor 8 to release brake 64. The pressurized hydraulic fluid supplied to motor 8 during reverse operation is supplied through conduit 96 and passage 98 to the annular space 90 between piston member 76 and housing 9. The pressurized hydraulic fluid from conduit 96 tends to expand the annular space 90 by moving piston member 76 away from brake discs 70 and 74, releasing brake 64. The brake is released only when sufficient fluid pressure is supplied through conduit 96 to overcome the force of springs 80. There is no tendency for the load to override the winch however. If the load starts to speed up the motor 8, the pressure of the hydraulic fluid in conduit 96 drops, engaging brake 8. Consequently, during the reeling-out operation, sufficient force must always be exerted by motor 8 to overcome the braking force of springs 80.

When brake 64 is released for reeling-out of cable from drum 2, rotation of primary internal gear 20 within housing 9 is permitted. However, sprag clutches 60 and 62 prevent rotation between shaft 12 and sleeve 22. When the brake 64 is released, drum 2 rotates, the final drive planetary hub 52 rotates about sun gear 44 with planet gears 56 and sun gear 44 rotates at an increased speed. However, in the reverse mode, the primary set of sun gear 18, planet gears 38 and internal gear 20 becomes inoperative and shaft 12 rotates at the same speed as shaft 42 since the sleeve 22 is connected to the drive shaft 12 through the sprag clutches 60 and 62. By the elimination of the primary set of planetary gears, the ratio of gear reduction between drum 2 and hydraulic motor 8 is appreciably reduced. In a typical winch according to an embodiment of the invention, reversing speeds are 4.3 times faster than forward speeds.

What we claim is:

1. A rapid reverse winch comprising:

a hollow winding drum rotatable about a longitudinal central axis;

a motor to a first side of the drum having a drive shaft coaxial with the central axis and extending towards a second side of the drum;

a primary sun gear connected to an inner end of the drive shaft;

a primary internal gear extending about the primary sun gear;

a primary planet hub between the primary sun gear and the primary internal gear;

a plurality of planet gears rotatably mounted on the primary planet hub in mesh with the primary sun gear and the primary internal gear;

a final drive sun gear to a second side of the drum and connected to the primary planet hub;

a non-rotatable drive housing with a final internal gear extending about the final sun gear;

a final drive planet hub between the final drive sun gear and the final drive housing and connected to the drum;

a plurality of planet gears rotatably mounted on the final drive planet hub in mesh with the final internal gear and the final sun gear; and free-wheel means between the drive shaft and the primary internal gear permitting rotation between the drive shaft and the primary internal gear when the motor rotates the drum in a winding-in direction and non-rotatably interconnecting the primary internal gear and the drive shaft when the drum is rotated in a reeling-out direction opposite to the winding-in direction.

2. A winch as claimed in claim 1, the primary internal gear, primary sun gear and the primary planet housing being located within the hollow winding drum generally near the centre thereof.

3. A winch as claimed in claim 2, comprising a sleeve rigidly connected to the primary internal gear and extending towards the first side of the drum about the drive shaft, the free-wheel means being between the drive shaft and the sleeve.

4. A winch as claimed in claim 3, the free-wheel means comprising a sprag clutch.

5. A winch as claimed in claim 4, comprising a brake engageable with a member mounted on the sleeve for resisting rotation of the drum.

6. A winch as claimed in claim 5, the brake comprising resilient means for engaging the brake and means for releasing the brake during reeling-out of the drum.

7. A winch as claimed in claim 6, the motor comprising a hydraulic motor, the means for releasing comprising hydraulic means for releasing the brake when the motor is operated in a reverse direction for reeling-out of the drum.

8. A winch as claimed in claim 7, the brake being to the first side of the drum.

9. A winch as claimed in claim 8, the brake comprising a brake disc connected to the sleeve and a piston member urged against the disc by the resilient means.

10. A winch as claimed in claim 9, comprising a plurality of said brake discs with spacer discs interposed therebetween, the piston member being annular and being located outwardly from the brake discs, the resilient means comprising a plurality of coil springs compressed between the piston member and an end housing of the winch, the hydraulic means comprising an annular space between the end housing and the piston member including an outer wall on the piston and an inner wall on the housing and a conduit for hydraulic fluid connecting the annular space to the motor.

11. A winch as claimed in claim 10, comprising a first bearing between the drum and the final drive housing, a second bearing between the drum and the end housing, a third bearing between the end housing and the sleeve, and a fourth bearing between the drive shaft and the sleeve.

* * * * *

UNITED STATES PATENT AND TRADEMARK OFFICE

CERTIFICATE OF CORRECTION

PATENT NO. : 4,227,680

DATED : October 14, 1980

INVENTOR(S) : Stan Hrescak

It is certified that error appears in the above-identified patent and that said Letters Patent are hereby corrected as shown below:

In col. 5, line 24 (claim 2, line 2), delete "housing" and substitute therefor --hub--.

Signed and Sealed this

*Seventeenth* Day of *March 1981*

[SEAL]

*Attest:*

RENE D. TEGTMEYER

*Attesting Officer*

*Acting Commissioner of Patents and Trademarks*